US005638639A

United States Patent [19]

Goodman et al.

[11] Patent Number: 5,638,639

[45] Date of Patent: Jun. 17, 1997

[54] EMERGENCY DOOR WITH RETRACTABLE NOSE PIECE, INTERIORLY MOUNTED OPERATING HARDWARE, AND HINGE SUPPORTS

[75] Inventors: E. Carl Goodman, Bountiful; Wallace D. Pack, Salt Lake City; Michael D. George, West Valley City; Ronald A. Smart; Ronald L. Richardson, both of Sandy; Craig Bell, West Valley City; Michael Hazlett, Kearns; James D. Porter, Salt Lake City, all of Utah

[73] Assignee: Won-Door Corporation, Salt Lake City, Utah

[21] Appl. No.: 235,494

[22] Filed: Apr. 28, 1994

[51] Int. Cl.[6] ..... E05F 15/20

[52] U.S. Cl. ..... 49/7; 292/21; 292/DIG. 66

[58] Field of Search ..... 49/7, 8, 366, 367; 292/21, 92, DIG. 66

[56] References Cited

U.S. PATENT DOCUMENTS

| | | | |
|---|---|---|---|
| 3,112,817 | 12/1963 | Critchfield . | |
| 3,556,573 | 1/1971 | Miller . | |
| 3,590,531 | 7/1971 | Childs . | |
| 3,653,155 | 4/1972 | De Brunyn, Jr. et al. . | |
| 3,663,047 | 5/1972 | Zawadzki | 292/21 X |
| 3,846,939 | 11/1974 | Weaver . | |
| 3,888,046 | 6/1975 | Meisterheim . | |
| 3,940,886 | 3/1976 | Ellingson, Jr. . | |
| 3,969,845 | 7/1976 | Yulkowski . | |
| 3,973,289 | 8/1976 | Yulkowski . | |
| 4,009,537 | 3/1977 | Hubbard . | |
| 4,083,590 | 4/1978 | Folger | 292/21 X |
| 4,093,284 | 6/1978 | Yulkowski . | |
| 4,099,753 | 7/1978 | Gwozdz et al. | 292/DIG. 66 X |
| 4,145,900 | 3/1979 | Ohno | 292/DIG. 66 X |
| 4,204,369 | 5/1980 | Hubbard . | |
| 4,311,329 | 1/1982 | Kral | 49/7 |
| 4,428,153 | 1/1984 | Klinger et al. . | |
| 4,437,693 | 3/1984 | Godec | 49/8 |
| 4,488,378 | 12/1984 | Symon . | |
| 4,545,607 | 10/1985 | Yulkowski . | |
| 4,741,563 | 5/1988 | Cohrs | 292/21 |
| 4,839,988 | 6/1989 | Betts et al. | 292/21 X |
| 4,865,367 | 9/1989 | Choi | 49/7 X |
| 5,114,192 | 5/1992 | Toledo et al. | 292/21 |
| 5,169,185 | 12/1992 | Slaybaugh et al. | 292/21 X |

*Primary Examiner*—Kenneth J. Dorner
*Assistant Examiner*—Jerry Redman
*Attorney, Agent, or Firm*—Mallinckrodt & Mallinckrodt

[57] ABSTRACT

An emergency door, such as a fire door which closes automatically in case of fire, includes a nose piece which moves to an extended position when the door is closed to provide a seal of the gap otherwise present between the forward edge of the door and an adjacent door frame or door, and generally also interlocks with a mating portion of the adjacent frame or door. An addition latching element may be provided to extend from the top edge of the door and be received in a keeper when the door is closed. Door operating hardware, preferably all mounted interiorly of the door except for a push bar on one side of the door and a door handle on the other side, is operable to retract the nose piece and latching element when it is desired to open the door. The nose piece and latching element are held in retracted position when the door is open. A release device releases the latching element and nose piece to extend to extended position when the door is moved to a closed position. The release device is easily operable so the doors are reliably closeable by a door closer device. The doors may be hinged by a hinge piece received in respective door and jamb receiving channels, and if so, the hinge piece is supported by a block at the bottom of the jamb channel and the door is supported by a block at the top of the door channel.

25 Claims, 8 Drawing Sheets

114
40
106
86
108
78
180
116
75
113
111
105
72
107
76
77
71
41
87
78
180

176
170
172
165
171
163
77
166
160
161
78
76
75
81
115
72
162
167
76
77
175
177
168
41
78
164
178

37
131
135
120
75
129
130
141
140
128
144
127
121
143
126
123
125
71
122
152
153
151
80
89
90
113
87
9
107
112
113
111
114
180
105
108
180
116
216
213
210
211
72
82
160
81
8
205
204
191
175
8
165
166
162
176
167
164
173
168
174
184
185
82
37
169
181
170
84
103
180
102
95
103
115
101
98
104
180
183

EMERGENCY DOOR WITH RETRACTABLE NOSE PIECE, INTERIORLY MOUNTED OPERATING HARDWARE, AND HINGE SUPPORTS

SPECIFICATION

BACKGROUND OF THE INVENTION

1. Field

The invention is in the field of fire or other emergency doors which are generally maintained open during normal situations, but in case of fire and sometimes other emergencies, are closed, often automatically.

2. State of the Art

Fire doors which serve to seal off an area of a building in the event of a fire are commonly required in public buildings. Increasingly, strict requirements for such doors are being imposed. In new installations it is not unusual that codes require that the doors, when dosed, provide a fire seal from one side to the other and maintain integrity and the seal for set periods of time with extreme fire temperature on one side of the door. This requires that any cracks between a door and the door frame and between doors themselves when double doors are used be effectively sealed against heat and fire transfer. Further, in many cases, these doors are normally maintained in open condition and are automatically closed by a mechanical door closer apparatus when an emergency condition is detected. Thus, the doors must close easily.

U.S. Pat. No. 3,973,289 shows a door hinge which includes a curved hinge piece extending between a door jamb mounting channel and a door mounting channel wherein the hinge piece rotates in the respective mounting channels to allow swinging of the door. This arrangement provides hinging of the door along the entire hinged side of the door, and seals any gaps that otherwise would be present between the door and door jamb with traditional hinges. In order to prevent relative longitudinal (vertical) movement of the door with respect to the hinge piece and of the hinge piece with respect to the jamb mounting, it is necessary to install and maintain hanger straps which stretch between the top of the hinge piece to the bottom of the door and from the top of the jamb channel to the bottom of the hinge piece.

U.S. Pat. Nos. 3,969,845, 4,093,284, and 4,545,607 show doors including a nose piece extending along the forward edge of the door and rotatably or pivotally mounted thereto so that in closing the door, the nose piece rotates into a closed position about a mating projection on the door frame or adjacent door to close any gap along the forward edge of the door that might otherwise be present when the door is closed and to lock the door in closed position. In such doors, the rotating nose piece of the door is rotated into its dosed position by the force on the door and the nose piece as the door is closed. Thus, the door must be closed with enough force to rotate the nose piece. The nose piece is locked into its rotated, closed position when the door is closed to maintain and lock the door in such closed condition.

Numerous emergency or exit doors are known wherein the doors are held in closed position by latching elements which extend from the door, usually from the top edge, the bottom edge, or both, into receiving recesses. Hardware for operating such doors usually takes the form of so called "panic hardware" wherein a push bar is provided on one side of the door which is pushed to retract the latching elements and open the door. Generally, all of the hardware and the latching elements operated thereby are hung on the outside of the door. Thus, the hardware extends from the side of the door and is completely visible.

SUMMARY OF THE INVENTION

According to the invention, an emergency door has a nose piece adapted to extend from the forward edge of the door when the door is in closed position to close the normal gap between the leading edge of the door and either an adjacent door frame or adjacent door, and to retract toward the forward edge of the door when the door is opened and remain in retracted position while the door remains in open condition. The nose piece is moved to its retracted position by operation of door mounted hardware such as conventional door knobs or handles or push bars generally referred to as panic hardware. Once moved to its retracted position, catch means holds the nose piece in retracted position while the door is open. Generally, the nose piece will be biased to extended position by biasing means such as spring means or by gravity. When the door is moved to closed position, release means releases the catch means and the nose piece is allowed to move to extended position to close the gap between the door and the adjacent door frame or adjacent door. In many instances, such as when a single door is used and the nose piece extends into a mating channel or around a mating projection on the door frame, the nose piece in extended position is sufficient to maintain the door in its dosed condition. The nose piece has to be retracted by operation of the door hardware to open the door.

When double doors are involved, additional latch means will generally be provided, which extend from a door, either from the top edge or bottom edge of the door, or both, to be received in a receiving recess in normal manner when the door is in closed position to thereby securely hold the door in closed position. In such instance, the latching means is retracted into the door from the recess when the nose piece is retracted, to allow the door to open, and will remain in retracted position, similarly to the nose piece, while the door remains in open condition. When the door is closed, the release means releases both the nose piece and the latch means from their retracted positions.

With the nose piece and latch means, if present, held in retracted position when the door is open and with the nose piece and latch means biased to extended position, a door of the invention may be easily closed and the only force required to close the door is a force sufficient to operate the release means which releases the biased nose piece and the latching means to move to extended position to hold the door in closed position. Because the nose piece and latching means are biased to extended position, no energy is needed upon closing the door to move them to extended position. The force to move the nose piece and latching means is applied by the door hardware upon opening the door when the nose piece and latching means are moved to retracted position against a bias force. This arrangement allows the doors to be reliably closed by a mechanical door closer.

The operating hardware of the door provides a linkage between the push bar and a retraction bar mounted within the door and linked to the nose piece and latching element so the nose piece and latching element are retracted upon pushing the push bar. The door operating hardware is all located out of sight within the door except for the push bar which extends from the door when the door is in closed position so it can be pushed by a person desiring to open the door.

The doors may be hinged to a wall or other door jamb by an elongate hinge piece of generally C-shape having opposite, inwardly directed, elongate margins, one margin adapted to be captured by and held in a door hinge piece receiving channel along the rearward edge of the door and the other margin adapted to be captured by and held in a jamb hinge piece receiving channel secured to the wall or other door jamb where the door is to be mounted. A block closing the bottom of the jamb channel supports the hinge piece in the jamb channel and a block dosing the top of the door channel supports the door on the hinge piece. This securely supports the door without the need of other hangers for the hinge piece and door.

THE DRAWINGS

The best mode presently contemplated for carrying out the invention is illustrated in the accompanying drawings, in which:

FIG. 1 is perspective view of a building corridor and elevator lobby required to be separated by a fire door in case of fire in the building;

FIG. 2, a perspective view similar to that of FIG. 1, but showing the fire doors in dosed condition;

FIG. 3, a fragmentary horizontal section taken on the line 3—3 of FIG. 1, showing the door hinge and nose piece of the left hand door in the open position shown in FIG. 1, and with an intermediate portion of the door broken away;

FIG. 4, a fragmentary horizontal section taken on the line 4—4 of FIG. 1, showing the door hinge and nose piece of the right hand door in the open position shown in FIG. 1, and with an intermediate portion of the door broken away;

FIG. 5, a fragmentary horizontal section taken on the line 5—5 of FIG. 2, showing the door hinges and nose pieces of the two doors when in the dosed position shown in FIG. 2, and with intermediate portions of the doors broken away;

FIG. 6, a fragmentary vertical section taken on the line 6—6 of FIG. 5, showing the mounting of the nose piece for the left hand door in FIG. 2 with the nose piece in its extended position;

FIG. 7, a fragmentary vertical section taken on the line 7—7 of FIG. 3, and similar to FIG. 6, but showing the mounting of the nose piece for the left hand door in its open condition with the nose piece in its retracted position;

FIG. 8 a fragmentary horizontal section taken on the line 8—8 of FIG. 6, showing the coupling between the nose piece and the door hardware with the nose piece in extended position;

FIG. 9, a fragmentary horizontal section taken on the line 9—9 of FIG. 6, showing a nose piece mounting link with the nose piece in extended position;

FIG. 10, a fragmentary horizontal section taken on the line 10—10 of FIG. 7, and similar to FIG. 8, showing the coupling between the nose piece and the door hardware with the nose piece in retracted position;

FIG. 11, a fragmentary horizontal section taken on the line 11—11 of FIG. 7, and similar to FIG. 9, showing the nose piece mounting link with the nose piece in retracted position;

FIG. 12, a perspective assembly view of the forward door edge and the nose piece of the left hand door showing how the nose piece is mounted to the door and to the door hardware, and with portions of various parts broken away;

FIG. 13, a fragmentary perspective view of the mounting of the door latch in the upper portion of the door as shown in FIGS. 6, 7, and 12, but rotated 180° therefrom, and showing the latch in its retracted position;

FIG. 14, a fragmentary vertical section taken on the line 14—14 of FIG. 13;

FIG. 15, a fragmentary vertical section looking at the top portion of the latch of FIG. 13 from the left, showing the latch in retracted position as shown in FIG. 13 in solid lines and showing the latch in extended position in broken lines;

FIG. 16, a fragmentary horizontal section taken on the line 16—16 of FIG. 1, showing the door hardware comprising a door handle and panic hardware with the nose piece and panic hardware in the retracted position, and with portions thereof broken away;

FIG. 17, a fragmentary horizontal section similar to FIG. 16, but with the nose piece and panic hardware in the extended position;

FIG. 18, a fragmentary vertical section taken on the line 18—18 of FIG. 16;

FIG. 19, a fragmentary vertical section taken on the line 19—19 of FIG. 18;

FIG. 20, a fragmentary vertical section taken on the line 20—20 of FIG. 18;

FIG. 21, a perspective assembly view of the panic door hardware;

FIG. 22, an exploded perspective assembly view of a portion of the panic hardware shown in FIG. 21;

FIG. 23, a fragmentary horizontal section taken on the line 23—23 of FIG. 2, showing details of the door hinge mounting; and FIG. 24, a fragmentary vertical section taken on the line 24—24 of FIG. 23.

DETAILED DESCRIPTION OF THE ILLUSTRATED EMBODIMENT

In many public and commercial buildings, it is necessary to separate areas of the building in case of fire to restrict the spread of fire through large open common areas or down long corridors of the building. For example, it may be necessary to separate an elevator lobby, 30, FIG. 1, from a corridor 31, FIGS. 1 and 2, in case of fire or other emergency. In such instances, it is necessary to install fire doors, such as fire doors 32 and 33, which will close as shown in FIG. 2, to separate the elevator lobby 30 from the corridor 31.

It is also required in most new installations that the doors remain open during normal conditions and that they close automatically upon the sensing of a fire in the building or upon other emergency situations where closing might be desired, such as for security reasons. For this purpose, the doors are incorporated into the building security and alarm system. This will generally mean that each door will be held open by an electromagnetic door hold device, such as shown schematically at 34, FIG. 2, and will be provided with a door closer device shown schematically at 35. These devices are currently well known with, for example, a model EM508 door hold open device as made by American Devices, and a model TS93 door closer as made by Dorma, generally satisfactory for use in a door installation of the invention.

Figure 1:
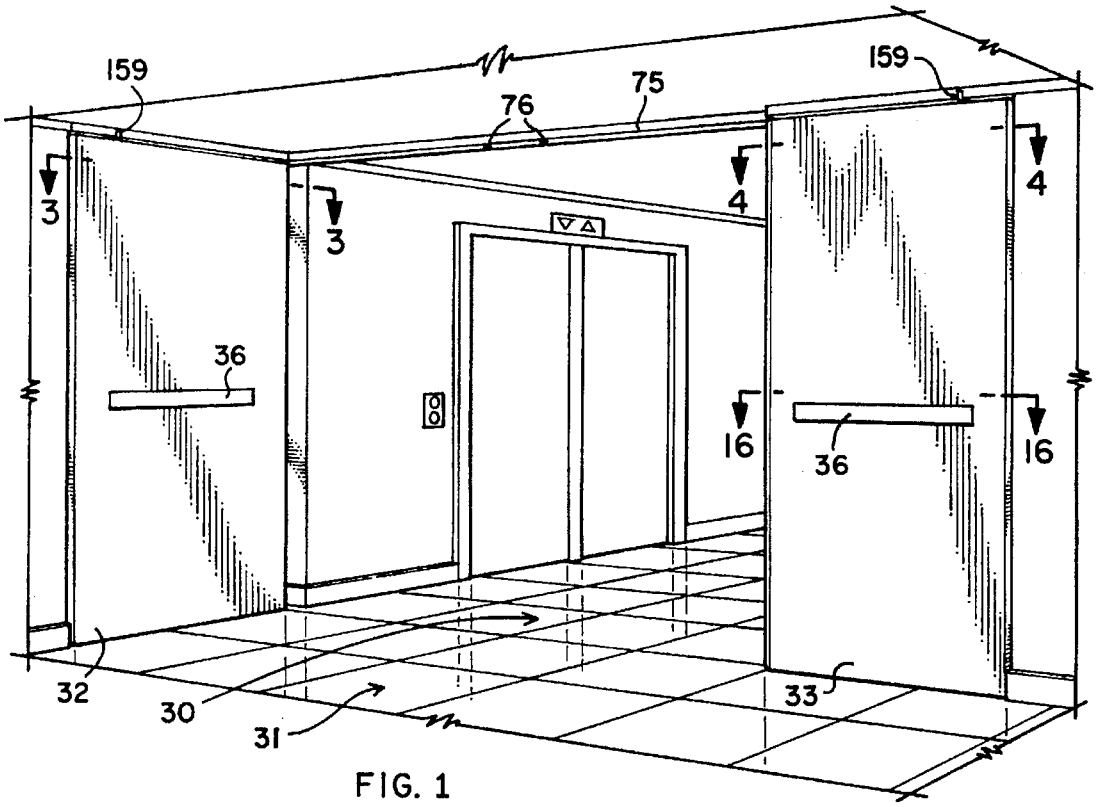
Figure 2:
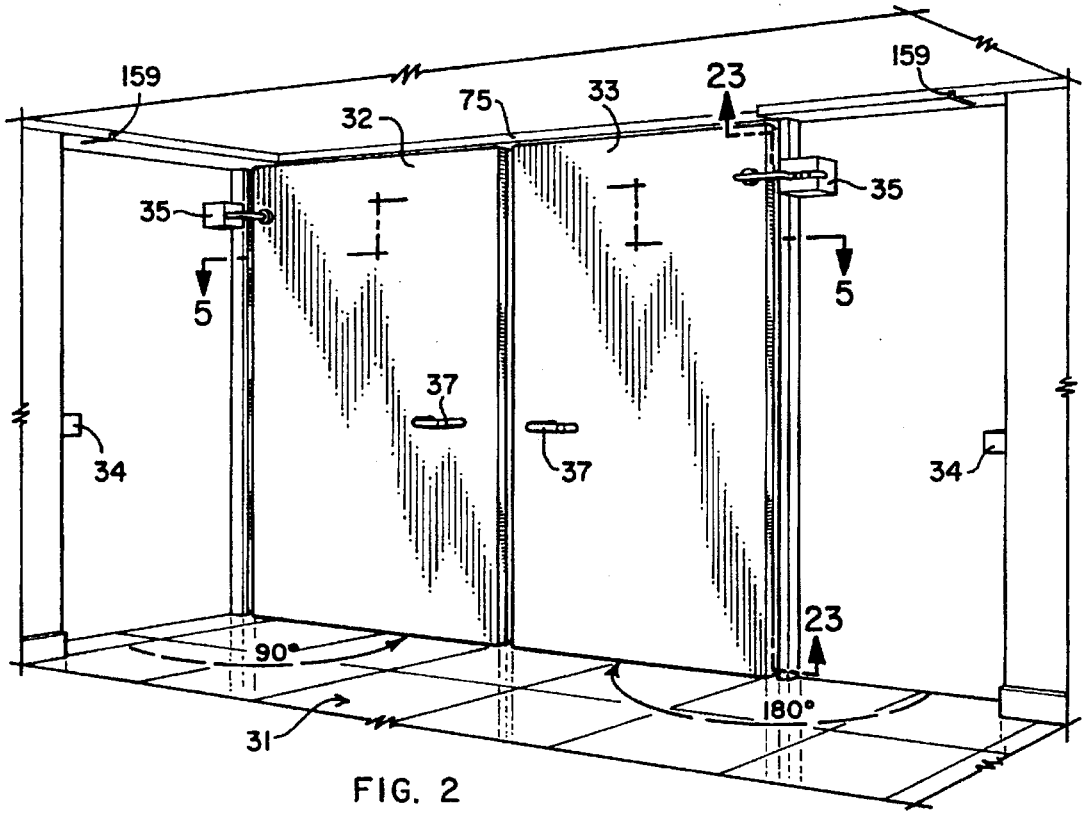

As installed, the magnetic door hold open devices will normally be activated as part of the building security and fire detection system to hold the doors in open condition as shown in FIG. 1. Upon detection of a fire, the system deenergizes the door hold open devices 34 to release the doors. Upon release of the doors, the door closer devices 35 operate to move the doors from open position shown in FIG. 1 to dosed position shown in FIG. 2. When using door closer devices, it is important that the doors be able to be completely dosed and latched on a reliable basis with the amount of force that is normally applied by the door closer.

When closed, the doors may be opened from the closed space, (here shown as the elevator lobby 30 and, to escape from which, a person would generally have to pass through these fire doors) by panic bars 36 which merely need to be pushed by the person desiring to open the door to push the doors open. The doors may be opened from the corridor by handles 37 which are rotated in normal fashion to unlatch a door and then used to pull the door open. However, various other types of door hardware could be used, particularly in place of the door handles 37.

Fire doors will be used in various configurations depending upon the size and configuration of the building spaces to be separated. Thus, a single door may be all that is required to dose and divide particular spaces, or double doors, as shown, may be required. It may be sufficient to rotate a door through 90°, as shown for door 32, the left hand door in FIGS. 1 and 2, or it may be necessary for a door to be mounted to rotate through up to 180° as shown for door 33, the right hand door in FIGS. 1 and 2. It is, therefore, desirable to provide a door which can operate alone or with another door and which will operate satisfactorily through a wide range of mountings. It is also desirable to provide a door which aesthetically fits into a building's interior in an unobtrusive manner. Further, for fire door application, the doors are required to provide a fire seal which generally requires that there are no gaps between the edges of the doors and the door frame or between pairs of mating doors.

Figure 4:
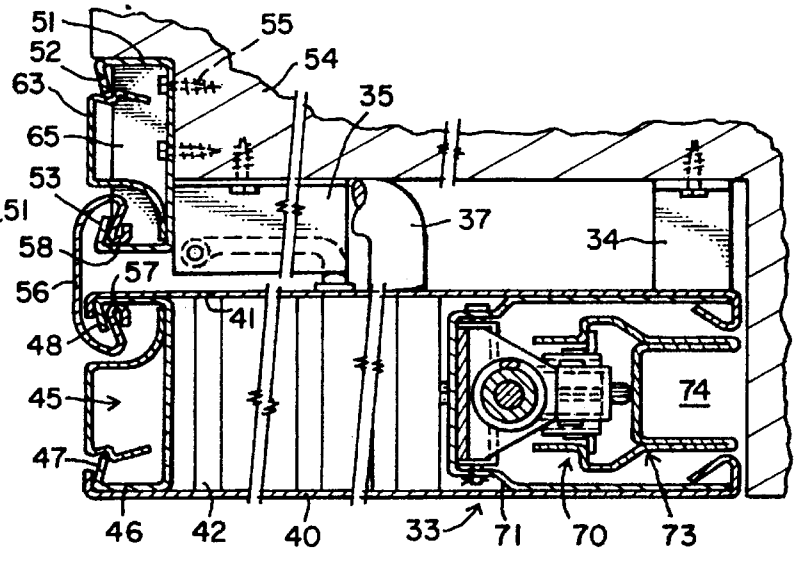
Figure 3:
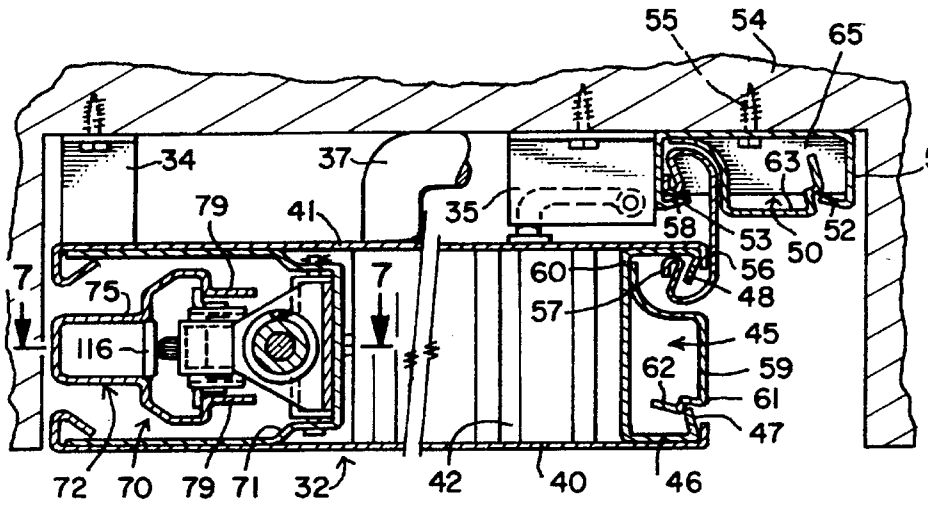
Figure 5:
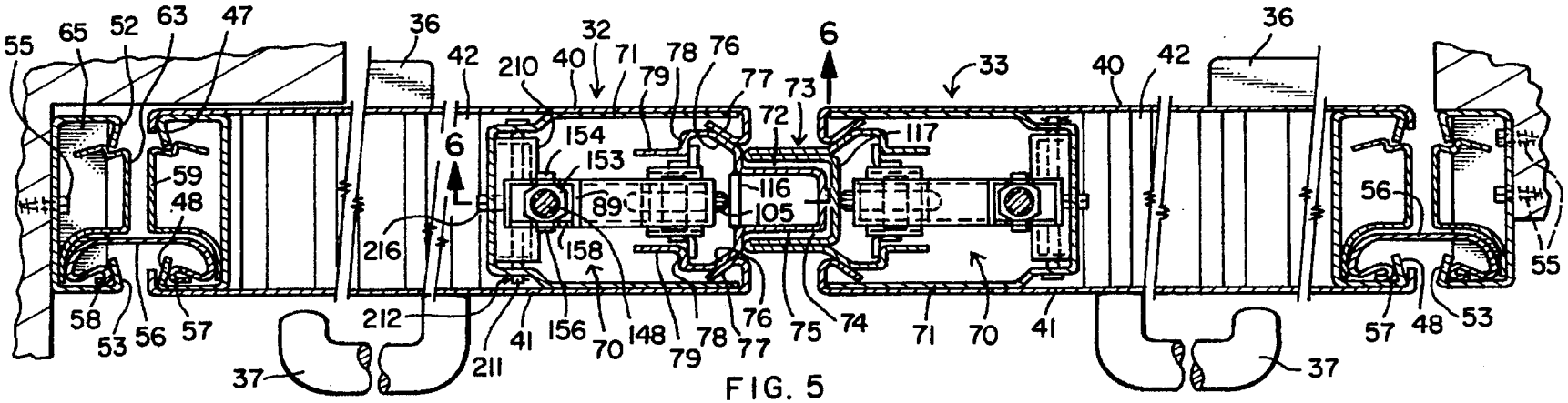

The doors themselves may be constructed in any known manner, such as with steel sides 40 and 41, FIGS. 3, 4, and 5, sandwiching a honeycomb core 42 therebetween. This is standard fire door construction and will not be described in detail as the invention does not deal with the basic door construction, but with the mounting and operation of a nose piece along the forward edge of the door, the mounting of the door hardware to operate the nose piece and an optional door latch, and, in some cases, the hinge mounting of the door.

While the doors of the invention could be hingedly mounted in various ways, it is presently preferred to provide a door hinge piece receiving channel 45, FIGS. 3, 4, 5, 23, and 24, along the rearward edge of the door formed by a steel channel piece 46 secured, such as by welding, along the rearward edge of the door between door sides 40 and 41. Channel piece 46 is generally of U-channel shape, but includes forward side flanges 47 and 48 which extend a short distance toward one-another into the channel. A jamb hinge piece channel 50, is formed by a similarly shaped steel channel piece 51 with flanges 52 and 53 which is secured to wall 54 or other door jamb surface such as by screws 55.

A hinge piece 56 of generally C shape having opposite, inwardly directed elongate margins 57 and 58 extends between the door hinge piece receiving channel 45 and the jamb hinge piece receiving channel 50, with hinge piece margin 57 received and held by door channel flange 48 and hinge piece margin 58 received and held by jamb channel flange 53. A door hinge piece retainer 59 is positioned in door channel 45, with an edge 60 abutting a side of channel piece 46 and having an opposite side retaining groove 61 against flange 47 to hold the retainer 59 in position in channel piece 46. Retainer piece 59 may be slid into place in channel piece 46, or may be of a spring steel material with angled edge 62 so that with edge 60 in channel piece 46, edge 62 can be deformed to allow positioning of channel flange 47 in retainer groove 61. Retainer 59 keeps hinge piece 56 retained in door channel 45.

A jamb channel retainer 63, similar to door channel retainer 59, maintains hinge piece 56 in jamb channel 50.

As can be seen from FIGS. 3, 4, and 5, such a hinge arrangement allows a door to swing through as much as 180°. The hinge arrangement with the doors closed is shown in FIG. 5. The hinge arrangement with a door rotated open 90° is shown in FIG. 3, and with a door rotated open 180° is shown in FIG. 4. Further, the hinge piece involved extends between the jamb and the door so closes the gap that might otherwise exist between a jamb and door. No door framing for the rearward side of the door is required so nothing needs to extend inwardly from the wall to seal a door opening. A door can be unobtrusively mounted in a recess in a wall as shown in FIG. 1.

The hinge arrangement described so far is currently known and used. However, as will be apparent, without support, the hinge piece 56 is free to slide along jamb channel 50 and along door channel 45 and door channel 45, along with the door involved, is free to slide along the hinge piece 56. This means that without support, hinge piece 56 and the door hinged thereby can slide to and rest on the floor. With current hinges of this type, hangers are provided to maintain the relative desired position of the hinge piece in relation to the jamb channel and the door channel and door in relation to the hinge piece. However, such hangers are difficult to install and maintain. A feature of the present invention is to provide a closure or block 65, FIGS. 3, 4, 5, 23, and 24, at the bottom of jamb channel 50. This preferably takes the form of a steel plate welded in the bottom of jamb channel piece 51, FIG. 24. With block 65 secured in the bottom of jamb channel 50, hinge piece 56 will rest by gravity on and be supported by such block 65. Hinge piece 56 will not move vertically in relation to jamb channel 50. Jamb channel retainer 63 is also supported by block 65. A closure or block 66 is also positioned in the top of door channel 45. This preferably takes the form of a steel plate welded in the top of door channel piece 46. This block 66 rests on top of hinge piece 56 and supports the door. With the block at the top of door channel 45, door channel 45 is held by gravity on and is supported by hinge piece 56 and the door will not move vertically with respect to the hinge piece. If door channel retainer piece 59 is not held in position sufficiently by friction fit, a block may be provided at the bottom of door channel 45 to hold retainer piece 59 in position or other holding means, such as a screw extending through retainer piece 59 and into door channel piece 51 may be used. With blocks 65 and 66, the door is easily supported by the hinge arrangement shown without the use of hangers. If desired, the hinge piece 56 can be notched at top and bottom to accommodate the blocks without providing any extra gap at the top or bottom between the door and frame.

Each door of the invention includes a nose piece along the forward edge of the door which is retracted into the door to allow the door to close and, when the door is closed, moves to an extended position to close the normal gap between the forward edge of the door and the door frame or jamb when a single door is used, or the forward edge of an adjacent door if double doors are used. It is preferred that the nose piece receive, or be received by, a mating piece mounted on the adjacent door frame if a single door is used or on the forward edge of an adjacent door if double doors are used. Thus, each of doors 32 and 33, FIGS. 3, 4, and 5, have a forward nose piece mounting channel 70 therein formed by a steel channel piece 71 secured between door sides 40 and 41. A male nose piece 72 is mounted in channel 70 of door 32, while a female nose piece 73, with receiving groove 74, is mounted in channel 70 of door 33. When in closed position with the nose pieces extended as shown in FIG. 5, the forwardly extending portion 75 of male nose piece 72 is received in receiving groove 74 of female nose piece 73. This seals the space or gap between the two doors to prevent fire from moving therethrough. It also substantially retards the passage of high temperatures from fire on one side of the door to the other. Where a single door is used, the nose piece could be either a male or female piece and would mate with a female or male arrangement, respectively, on the door frame. When a door is opened, the nose piece is retracted into forward channel 70 of the door as shown in FIGS. 3 and 4.

When a single door is used and the nose piece is extended in closed position to mate with a mating piece on the door frame, the door will be substantially latched in such dosed position because of the interlocking of the door nose piece with a mating stationary piece on the door frame. The nose piece has to be retracted to allow the door to open. No further latching means is required for a single door. However, where double doors are used, as illustrated, further latch means are generally required to maintain the doors in dosed position against pushing force on the doors. In such instances, an additional latch is provided with a latching element which extends from the door in normal manner into a receiving recess or keeper when the door is closed to thereby latch the door in dosed position. The latching element can extend from the top or bottom of the door, or both. For most installations such as illustrated, where the door should be as unobtrusive as possible, the latching element will preferably extend from the top edge of the door so no receiving recesses are required in the floor to be noticed or collect dirt, and an unobtrusive framing strip 75, FIGS. 1 and 2, may be provided in the ceiling with receiving recesses 76, FIG. 1, therein to receive and hold the latching elements.

Since doors 32 and 33 are the same except door 32 has a male nose piece and door 33 has a female nose piece, and since the mounting and operation of the nose pieces are the same regardless of whether the nose piece is of male or female configuration, the details of the nose piece mounting and its operation will be described in detail only in connection with door 32 and the male nose piece. Further, since an additional latch means is used with a double door configuration, and may be used in a single door configuration, the doors are illustrated with the additional latch means and door 32 will be described in detail including the additional latch means. Similar parts of doors 32 and 33 will be designated by the same reference numbers.

Figures 6, 8, 9:
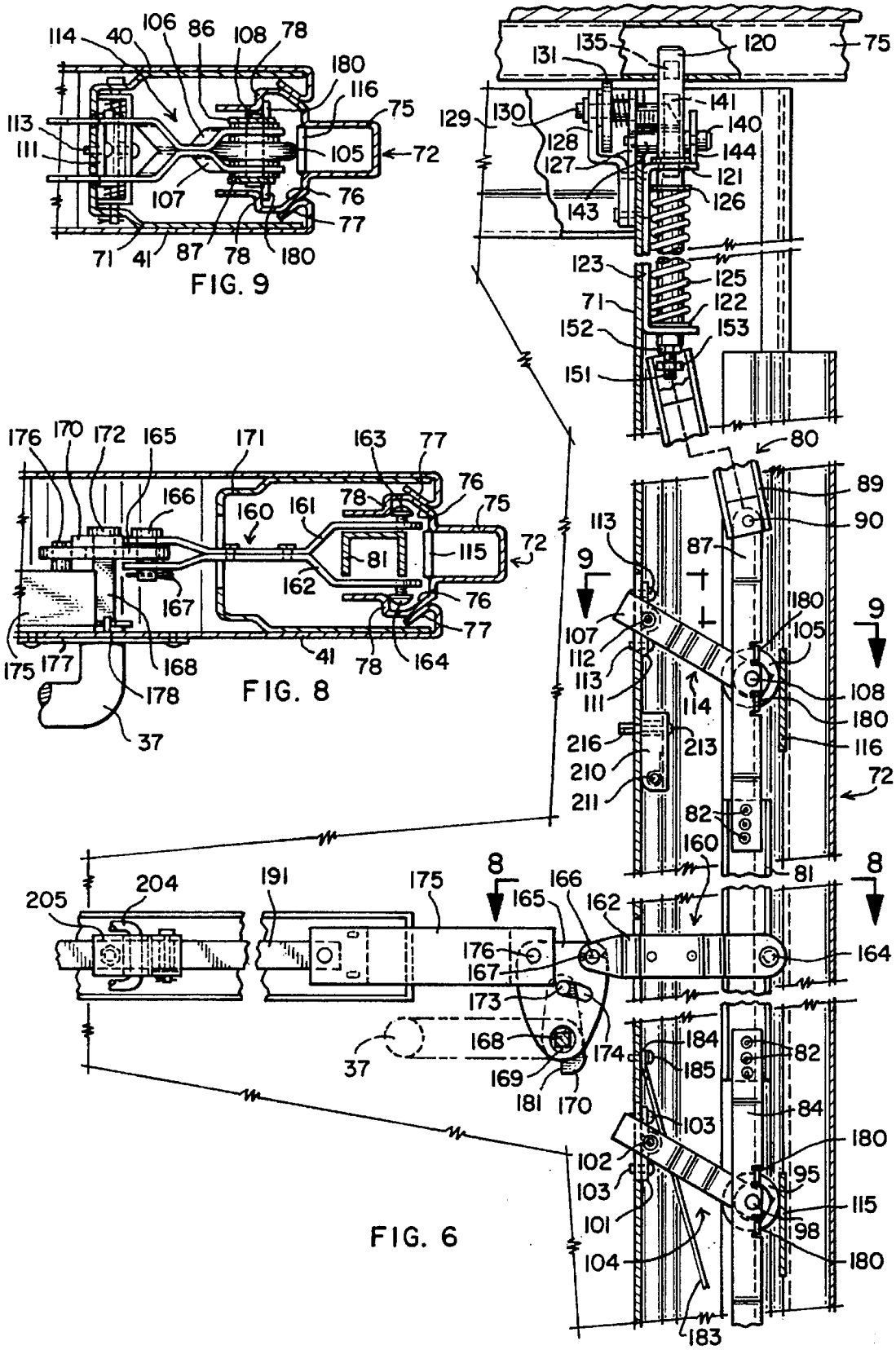
Figures 7, 10, 11:
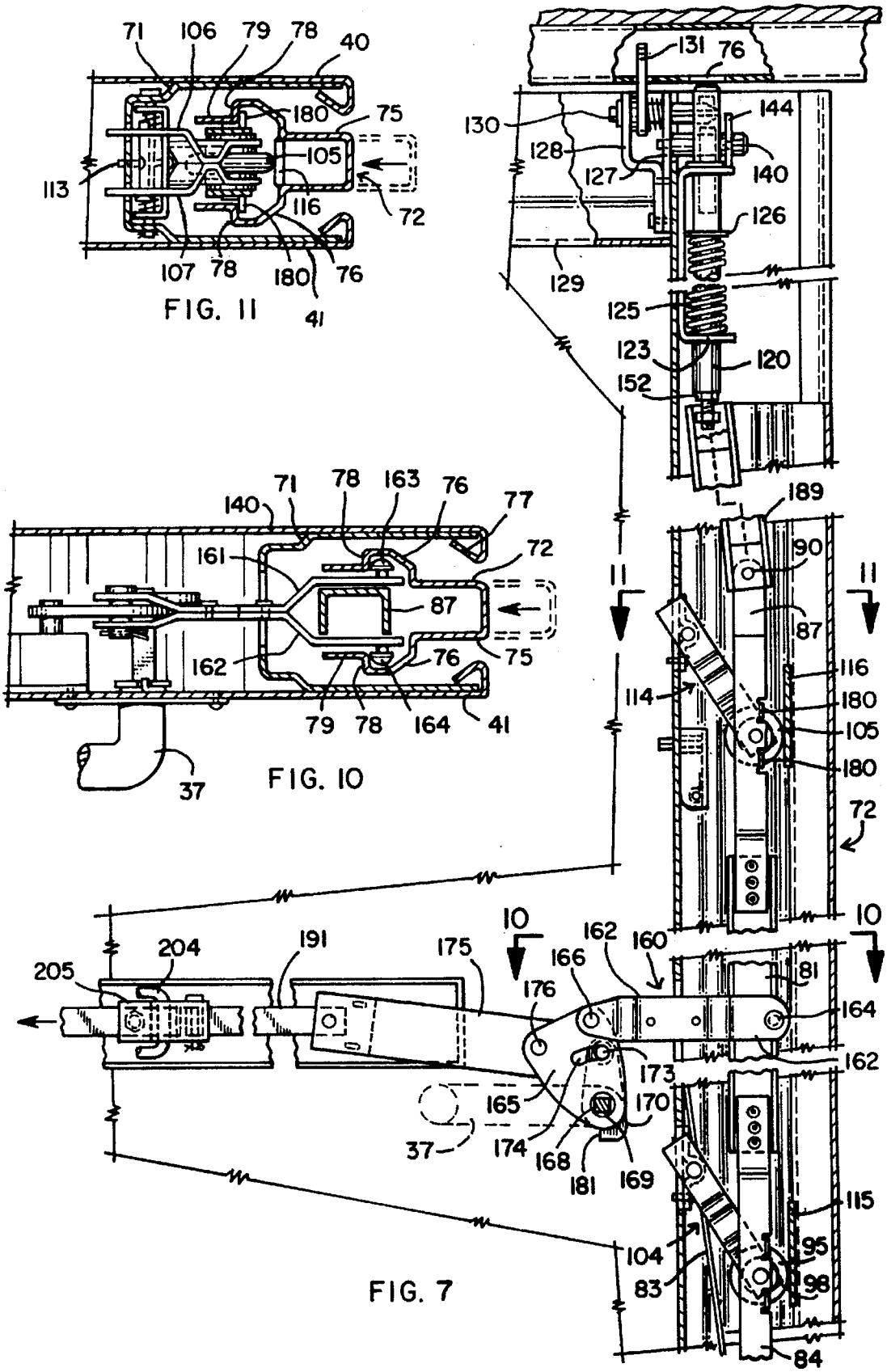
Figure 12:
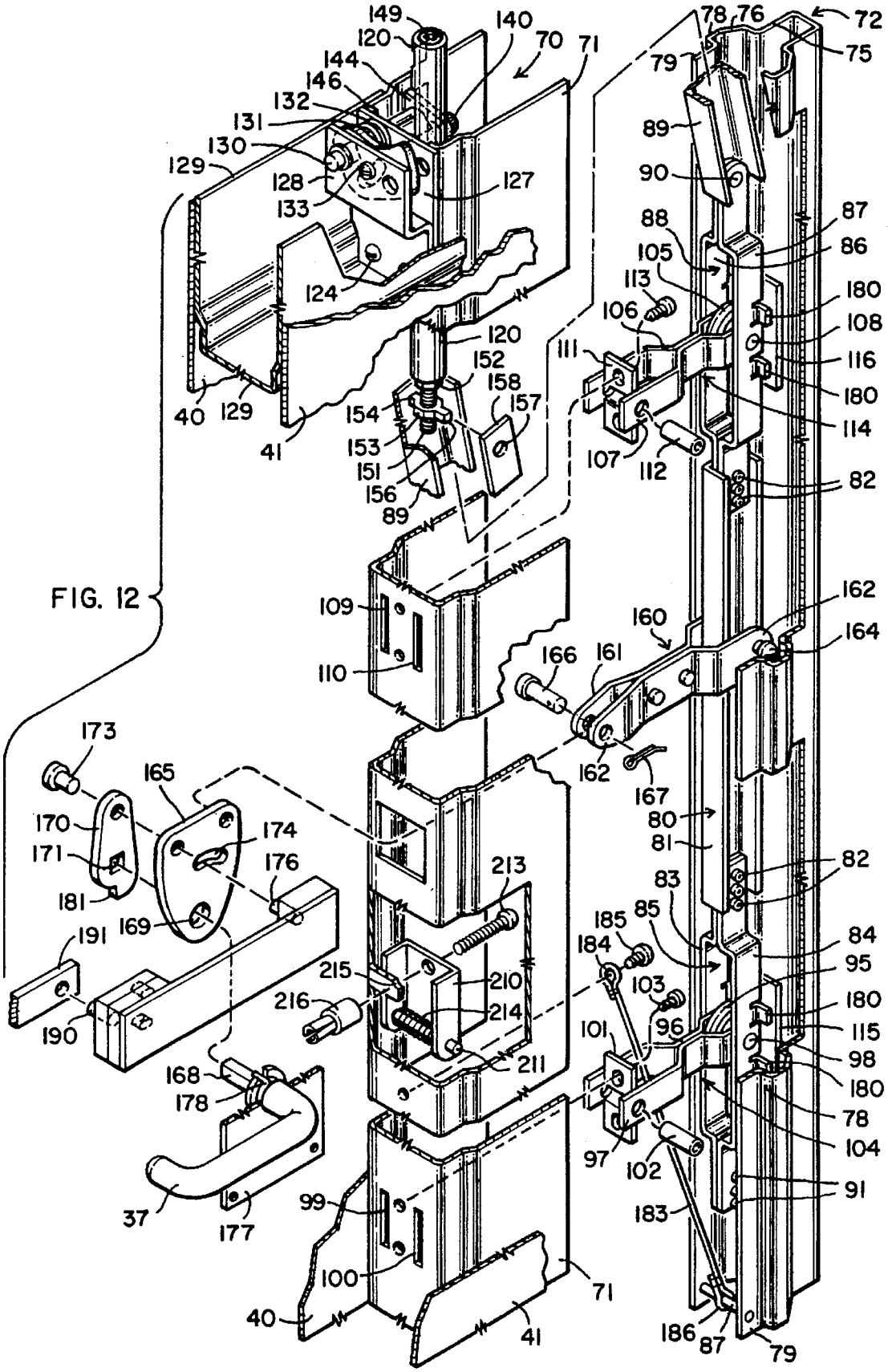

As shown in FIGS. 3 and 5, nose piece 72 is retractably mounted in forward nose piece mounting channel 70. Nose piece 72 is formed with a forward extension portion 75 adapted to extend beyond the forward edge of the door when the nose piece is in extended position, opposite rearwardly and outwardly sloped stop portions 76 adapted to abut mating sloped forward door stop surfaces 77 (formed by bending of door sides 40 and 41 around the forward edges of channel piece 71) to limit the extension of the nose piece 72, opposite inwardly projecting shoulder portions 78, and parallel rearwardly extending rear portions 79. As best seen in FIGS. 12, 6, and 7, a vertical nose piece control member 80 is made up of channel 81 rigidly connecting, such as by bolts or rivets 82, lower roller mounting frame pieces 83 and 84 which form a lower roller opening 85 and upper roller mounting frame pieces 86 and 87 which form an upper roller opening 88. An upper channel 89 is pivotally connected to the upper end of roller mounting frame pieces 86 and 87 by pivot pin 90. The lower ends of lower roller mounting frame pieces 83 and 84 are secured together by bolts or rivets 91.

Lower roller 95, along with outer ends of lower nose piece mounting link halves 96 and 97, which form a clevis for roller 95, are pivotally mounted between lower roller mounting frame pieces 83 and 84 in lower roller opening 85 by pivot pin 98. The opposite ends of lower nose piece mounting link halves 96 and 97 extend through slots 99 and 100 in the web of channel piece 71 and form a clevis for mounting plate 101 which holds pivot pin 102 to pivotally mount lower nose piece mounting link halves 96 and 97 to the web of channel piece 71. Mounting plate 101 is secured to the web of channel piece 71 by two screws 103, only one such screw being shown in FIG. 12. Lower nose piece mounting link halves 96 and 97 are secured together through their center portion to form lower nose piece mounting link 104.

Similarly, upper roller 105, along with outer ends of upper nose piece mounting link halves 106 and 107, which form a clevis for roller 105, are pivotally mounted between upper roller mounting frame pieces 86 and 87 in upper roller opening 88 by pivot pin 108. The opposite ends of upper nose piece mounting link halves 106 and 107 extend through slots 109 and 110 in the web of channel piece 71 and form a clevis for mounting plate 111 which holds pivot pin 112 to pivotally mount upper nose piece mounting link halves 106 and 107 to the web of channel piece 71. Mounting plate 111 is secured to the web of channel piece 71 by two screws 113, only one of such screws being shown in FIG. 12. Upper nose piece mounting link halves 106 and 107 are secured together through their center portions to form upper nose piece mounting link 114.

Lower and upper roller plates 115 and 116, respectively, are secured inside nose piece 72 across the male forward portion 75 to provide a surface against which lower and upper rollers 95 and 105 can roll. As seen from FIG. 5, which shows upper roller 105 against upper roller plate 116, a similar plate is not needed with the female nose piece as the portion 117 of the female nose piece forming the back or web of receiving channel 74 forms a surface for the rollers.

While two nose piece mounting links have been shown and described along with two associated rollers and two roller openings, depending upon the height of the door, it may be desirable to include additional nose piece mounting links, rollers, and roller openings along the height of the door.

A latch assembly is mounted at the top of the door in the top portion of channel piece 71, and is coupled to the vertical nose piece control member 80 through pivotally connected channel 89. As probably best seen in FIG. 13, but also seen in FIGS. 6, 7, 13, 14, and 15, a latching element 120 passes through upper and lower bearings 121 and 122, respectively, in latch bracket 123 secured by bolts 124 to the web of channel piece 71 so as to be slidably mounted in bracket 123. A coil spring 125 is compressed between lower bearing 122 and E-ring 126 secured in an annular groove on latching element 120. With this arrangement, spring 125 biases latching element 120 upwardly, i.e., it pushes E-ting 126 and latching element 120 upwardly, and if not otherwise restrained, would move latching element 120 upwardly until E-ring 126 abuts upper bearing 121 in bracket 123.

Figure 15:
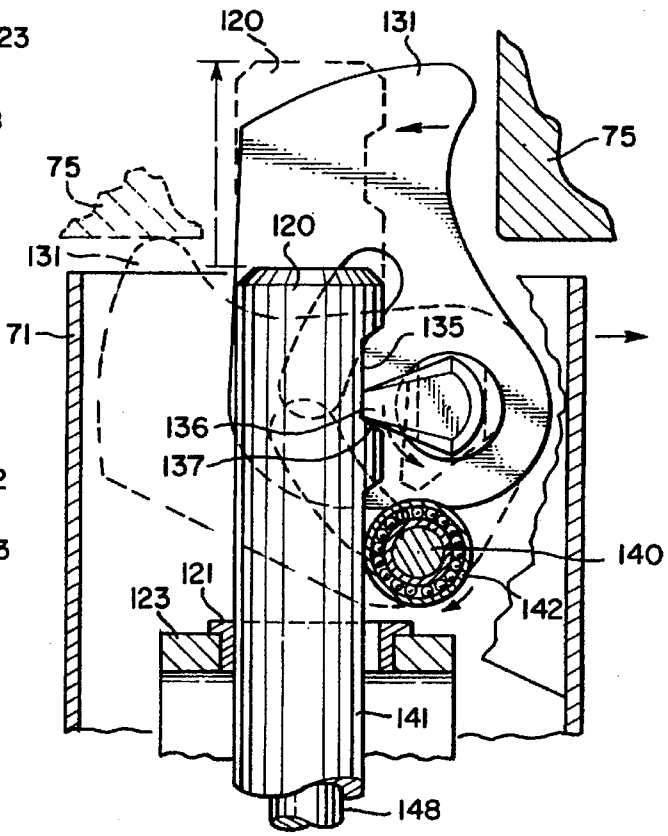
Figure 13:
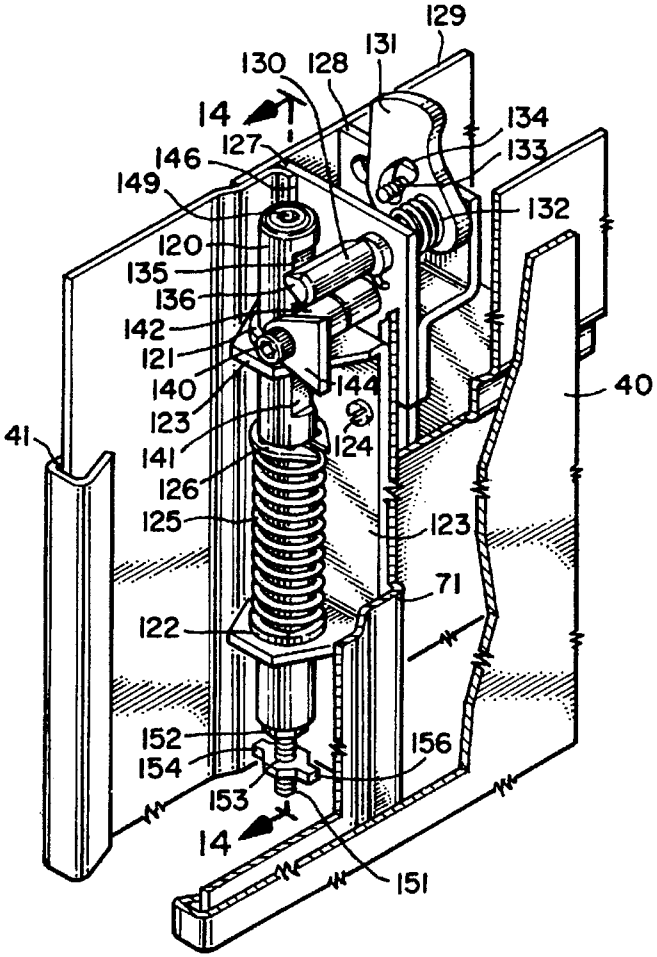

Bolts 124 which secure bracket 123 to the web of channel piece 71, also secure catch and release means bracket pieces 127 and 128 on the opposite side of the web of channel piece 71 in a door top channel piece 129. Trip pin 130 is journaled in bracket pieces 127 and 128 with trip cam 131 secured to trip pin 130 to rotate therewith between bracket pieces 127 and 128. Spring 132 around trip pin 130 has one end secured to bracket piece 127 and the other to trip cam 131 so as to bias trip pin 130 in a clockwise direction in FIG. 13 and bias trip cam 131 to its upstanding position shown in FIG. 13. A stop pin 133 extends into trip cam slot 134 to provide a limited range of rotation to trip pin 130 and trip cam 131. FIG. 13, and FIG. 15, solid lines, shows trip pin 130 and trip cam 131 in their biased position. FIG. 12, and FIG. 15, broken lines, show trip pin 130 and trip cam 131 in their rotated positions having been rotated counterclockwise from their biased positions.

Latching element 120 has an upper flat area 135 aligned with extended edge 136 of the portion of trip pin 130 adjacent latching element 120. The bottom of upper flat area 135 terminates in shoulder 137, FIG. 15. As shown in FIG. 15, with latching element 120 in retracted position as shown in solid lines, extended edge 136 of trip pin 130 rest against shoulder 137. Since stop pin 133 in slot 134 prevents further clockwise rotation of trip pin 130, extended edge 136 of trip pin 130 catches latching element 120 and holds it in retracted position as shown in solid lines in FIG. 15. If trip cam 131 is rotated in a counterclockwise direction in FIGS. 13 and 15, as it would by hitting ceiling door framing 75 when the door is moved to closed position, it rotates to the position shown in broken lines in FIG. 15. This rotates trip pin 130 and extended edge 136 in a counterclockwise direction to the position shown in broken lines in FIG. 15. This releases latching element shoulder 137 to allow latching element 120 to move to its extended position shown in broken lines in FIG. 15. Since trip pin 130 and trip cam 131 are biased to the position shown in FIG. 13 and solid lines in FIG. 15, if latching element 120 is retracted, and there is nothing to hold trip cam 131 in its rotated position shown by broken lines in FIG. 15, i.e., the door is moved toward open position so the trip cam is no longer held in rotated position by door framing 75, trip cam 131 and trip pin 130 will rotate because of the bias of spring 132 back to the position shown in solid lines in FIG. 15 and will latch latching element 120 in retracted position. As shown and described, trip pin 130, extended edge 136, and shoulder 137 form a catch means to catch and hold latching element 120, and, as will be described, nose piece 72, in retracted position. Trip cam 131 forms a release means to release latching element 120 and nose piece 72 to extended position when the door is moved to closed position.

In order to prevent latching element 120 from rotating and to keep latching element 120 from binding and being difficult to retract under substantial pressure against the door, shoulder bolt 140 extends from bracket piece 127 and latching element 120 is provided with lower fiat area 141. Needle beating 142 is rotatably mounted on shoulder bolt 140 between inside spacer 143 and outer spacer 144 so that it is held adjacent to and rests against latching element lower fiat area 141. Outer spacer 144 has a fiat surface 145 which rests against the side of channel piece 71, or may be secured thereto, to maintain the alignment of shoulder bolt 140 and needle beating 142 against high pressure applied to the extended end of latching element 120. The web of channel piece 71 may be cut away as at 146 where trip pin 130 and spacer 143 extend from bracket piece 127.

Figure 14:
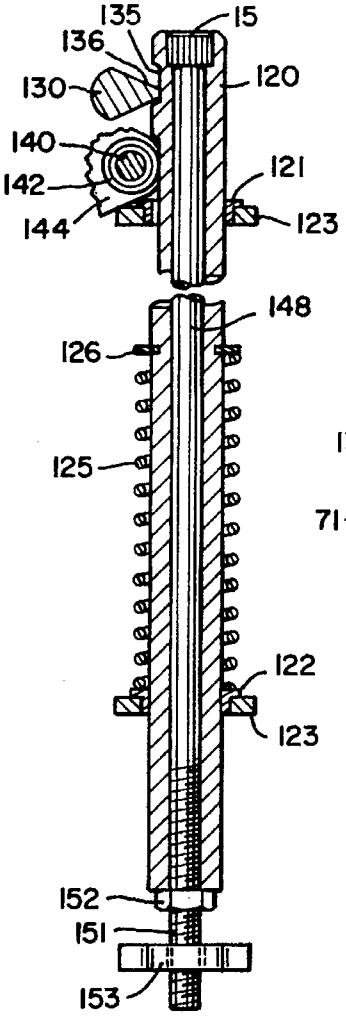

Latching element 120 has a central bore 147, FIG. 14, therethrough. Shoulder bolt 148, with hex opening 149, FIG. 13, in its head 150, FIG. 14, extends freely through central bore 147 and has a threaded end portion 151 extending beyond the end of the latching element 120. A nylock nut 152 is threaded onto the end portion of shoulder bolt 151 adjacent to the end of latching element 120 as shown in FIG. 14. Nylock nut 152 will not freely rotate on shoulder bolt 151 so once threaded into position thereon, will stay in that position. Nut 152 is not tightened against the end of latching element 120 so that shoulder bolt 148 remains freely rotatable in central bore 147 of the latching element 120. However, with nut 152 positioned adjacent the end of latching element 120, it prevents longitudinal movement of shoulder bolt 148 with respect to latching element 120. Ear nut 153 is threaded onto the lower part 151 of shoulder bolt 148 with an ear 154 pivotally captured in hole 155 in channel 89 of vertical nose piece control member 80, FIG. 12, and with opposite ear 156 pivotally captured in hole 157 in plate 158, secured to the open side of channel 89. With this arrangement, shoulder bolt 148 can be rotated with an Allen wrench in hex opening 149 to move ear bolt 153 up or down along the lower threaded portion 151. This, in turn, adjusts the relative position of vertical nose piece control member 80 in relation to latching element 120.

As can be seen in FIG. 6, when latching element 120 is released and moved by spring 125 to its extended position, it also pulls upwardly and causes upward movement of vertical nose piece control member 80. This is because of the direct connection of the latching element 120 through shoulder bolt 148 and ear nut 153 to channel 89 of the vertical nose piece control member 80. However, because of the connection of the vertical nose piece control member 80 to the web of channel piece 71 through pivoted nose piece mounting links 104 and 114, as vertical nose piece control member 80 moves upwardly from a position shown in FIG. 7 to a position shown in FIG. 6, mounting links 104 and 114 pivot about their mounting to the web of channel piece 71 causing vertical nose piece control member 80 to move outwardly from the web of channel piece 71. Also, as nose piece mounting links 104 and 114 rotate upwardly, rollers 95 and 105 move outwardly against roller plates 115 and 116, respectively, causing nose piece 72 to move outwardly from door channel 70 to extended position. Thus, movement of latching element 120 to its extended position under the influence or bias of spring 125 also causes nose piece 72 to move to its extended position. The travel of nose piece 72 to extended position is limited by nose piece stop portion 76 abutting mating sloped forward door stop surfaces 77. This also stops further extension of latching element 120.

As previously described, movement of latching element 120 and connected nose piece 72 to extended position is caused by the bias of spring 125 when nose piece 120 is released by rotating trip cam 131 and trip pin 130 when the door is closed. Once the door is closed, it is necessary to retract nose piece 72 and latching element 120 to open the door. This also resets trip pin 130 and trip cam 131 to catch and hold the latching element and nose piece in retracted position. Thus, when the door is dosed, operation of the door hardware, either panic hardware push bar 36 or handle 37, causes the nose piece and latching element to move to retracted position. When latched in retracted position by trip pin 130, trip cam 131 extends above the upper edge of the door. Thus, for the door arrangement shown in FIGS. 1 and 2 where the doors are retained in open position in door receiving recesses in the room or corridor wails, it is necessary to provide trip cam receiving slots 159 in the top door trim for passage of such extending cams.

In order to move the nose piece and latching element to retracted positions from their closed extended positions by operation of the door hardware, the door hardware is coupled to the nose piece by door hardware coupling 160, FIGS. 8 and 10, made up of door coupling halves 161 and 162 with outer ends spread apart in the nose piece to be adjacent the rearwardly extending rear portion 79 thereof. Screws 163 and 164 extend outwardly from the outer ends of coupling halves 161 and 162 within nose piece 72 and engage shoulder portions 78 of the nose piece. Thus, when door hardware coupling 160 is moved toward the door, it will pull nose piece 72 along with it toward the door to retracted position. As indicated above, when latching element 120 is released from retracted position, spring 125 moves it to extended position and also moves nose piece 72 to extended position. This pulls coupling 160 outwardly with nose piece 72. The inner ends of hardware coupling halves 161 and 162 are spread apart to form a clevis to receive nose piece retraction crank 165 therebetween, FIGS. 12, 8, 10, 6, and 7, with pin 166 pivotally connecting the halves to the crank. Pin 166 is retained in position by cotter pin 167.

Nose piece retraction crank 165 is mounted for free rotation about door handle shaft 168 which extends from door handle 37. The hole 169 in nose piece retraction crank 165 through which door handle shaft 168 passes is round so that although shaft 168 is square, crank 165 can freely rotate thereon. A door handle retraction crank operator 170 is positioned adjacent to retraction crank 165 and receives door handle shaft 168 in a square hole 171, FIG. 12, so that retraction crank operator 170 rotates with door handle shaft 168. An enlarged head 172 on the end of door handle shaft 168 maintains retraction crank 165 and retraction crank operator 170 in position. A pin 173 extends from retraction crank operator 170 into slot 174 in retraction crank 165. A panic hardware connecting bar 175 is pivotally connected to retraction crank 165 with pin 176. Operation of the panic hardware causes panic hardware connecting bar 175 to move horizontally into the door as will be described. Such movement of hardware connecting bar 175 causes retraction crank 165 to rotate in a counterclockwise direction, FIGS. 6 and 7, about door handle shaft 168. Door handle 37 with door handle shaft 168 extending therefrom is mounted on door side 41 by a usual mounting plate 177 with bias spring mechanism 178 to bias handle 37 to the horizontal position shown in FIGS. 12, 6, and 7.

In operation, if handle 37 is rotated downwardly, i.e., counterclockwise in FIGS. 12, 6, and 7, crank operator 170 rotates in a counterclockwise direction. Pin 173 engages the end of slot 174 and causes crank 165 to also rotate in a counterclockwise direction. This pulls, through hardware coupling 160, nose piece 72 in toward the door, i.e., into channel 70, to retracted position. As nose piece 72 is pulled into retracted position, rollers 95 and 105 roll on roller plates 115 and 116 and nose piece coupling links 104 and 114 rotate downwardly. This causes vertical nose piece operator 80 to move downwardly pulling latching element 120 downwardly to its retracted position. When handle 37 is released, even though nose piece 72 remains latched in retracted position as shown in FIG. 7, handle 37 rotates back to horizontal position shown in FIG. 7 by reason of biasing spring mechanism 178 and slot 174 which allows pin 173 to move therein to the opposite side of the slot as shown in FIG. 7. Rotation of retraction crank 165 by handle 37 will also cause panic hardware connecting bar 175 to move to the left. The effect of this is to move panic bar 36 into the door for aesthetic reasons when the door is open.

If, with nose piece 72 in extended position, the panic hardware is operated to cause panic hardware connecting bar 175 to move longitudinally into the door, i.e., to the left in FIGS. 6, 7, and 12, the panic hardware connecting bar 175 causes retraction crank 165 to rotate in a counterclockwise direction to pull, through hardware coupling 160, nose piece 72 toward the door to its retracted position. During such operation, handle 37 remains in horizontal position since pin 173 moves in slot 174 as retraction crank 165 rotates.

While latching member 120 and vertical nose piece control member 80 attached thereto are held latched in retracted position, nose piece 72 is positively held in retracted position by tabs 180 which extend from roller mounting frame pieces 83, 84, 86, and 87, shown for pieces 84 and 87 in FIG. 12, which abut nose piece shoulder portion 78, FIGS. 9 and 11, showing tabs 180 extending from pieces 86 and 87.

As indicated, the action of roller 95 and 105 on roller plates 115 and 116 cause the outward movement of nose piece control member 80 to be transferred to nose piece 72 (vertical movement of control member 80 is not transferred) and the inward movement of nose piece 72 as it is pulled to retracted position to be transferred to control member 80.

For some purposes it is desirable to provide a key type lock for door handle 37. If such is desired, a lock cylinder can be installed in normal manner to cooperate with notch 181 on crank operator 170. If handle 37 and crank operator 170 were locked, slot 174 would still allow full operation of the panic hardware on the other side of the door to open the door. In most installations, only handle 37 would be allowed to be locked. Panic hardware has to be always operable to allow the doors to be opened from the inside. With the provision of a lock for door handle 37, the door of the invention may be used as a conventional exit door. With handle 37 locked, entry from outside is restricted while the panic hardware still allows the door to be easily opened from the inside for exit purposes.

Nose piece 72 does not move up and down in relation to the door as does nose piece control bar 80, but should maintain a constant vertical position in relation to the door and merely move in relation to the door inwardly to retracted position and outwardly to extended position. Thus, nose piece 72 has to be supported in some way. While various means of support could be used, a cable hanger 183, FIG. 12, will support nose piece 72 from sliding vertically with respect to door 32. Cable hanger 183 has a looped end 184 secured to the web of channel piece 71 by screw 185. A hook 188 engages pin 187 extending between nose piece parallel rear portions 79 to supports nose piece 72 so it does not slide downwardly. If cable hanger 183 is relatively long, such as about eighteen inches, it will impart no significant vertical movement to the nose piece as the nose piece moves between extended and retracted position. It has been found that gravity will maintain nose piece 72 in position against upward movement so means to prevent upward movement is generally not necessary.

The detailed arrangement and operation of the panic hardware of the invention is shown in FIGS. 16–22 and is shown and described in connection with door 33 and female nose piece 73. However, the arrangement and operation of the panic hardware is the same for both doors. An important feature of the panic hardware of the invention is that the hardware is built completely into the door and is not attached or hung on the outside of the door. In addition, when a door is open and nose piece retracted, the push bar 36 for the hardware is maintained substantially flush with the door surface so remains an unobtrusive part of an unobtrusive door.

Figures 16, 17, 18, 19, 20:
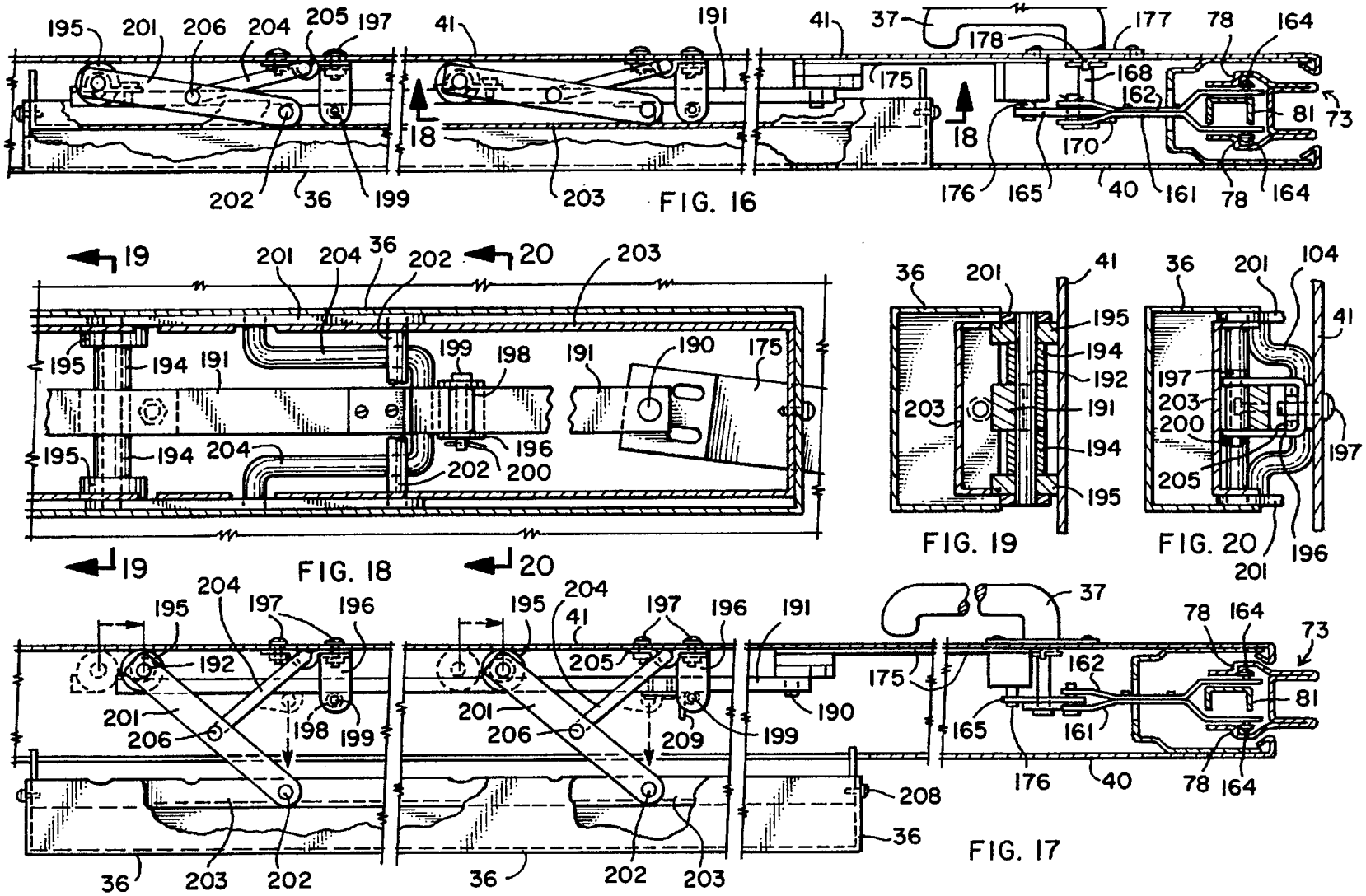
Figures 21, 22, 23, 24:
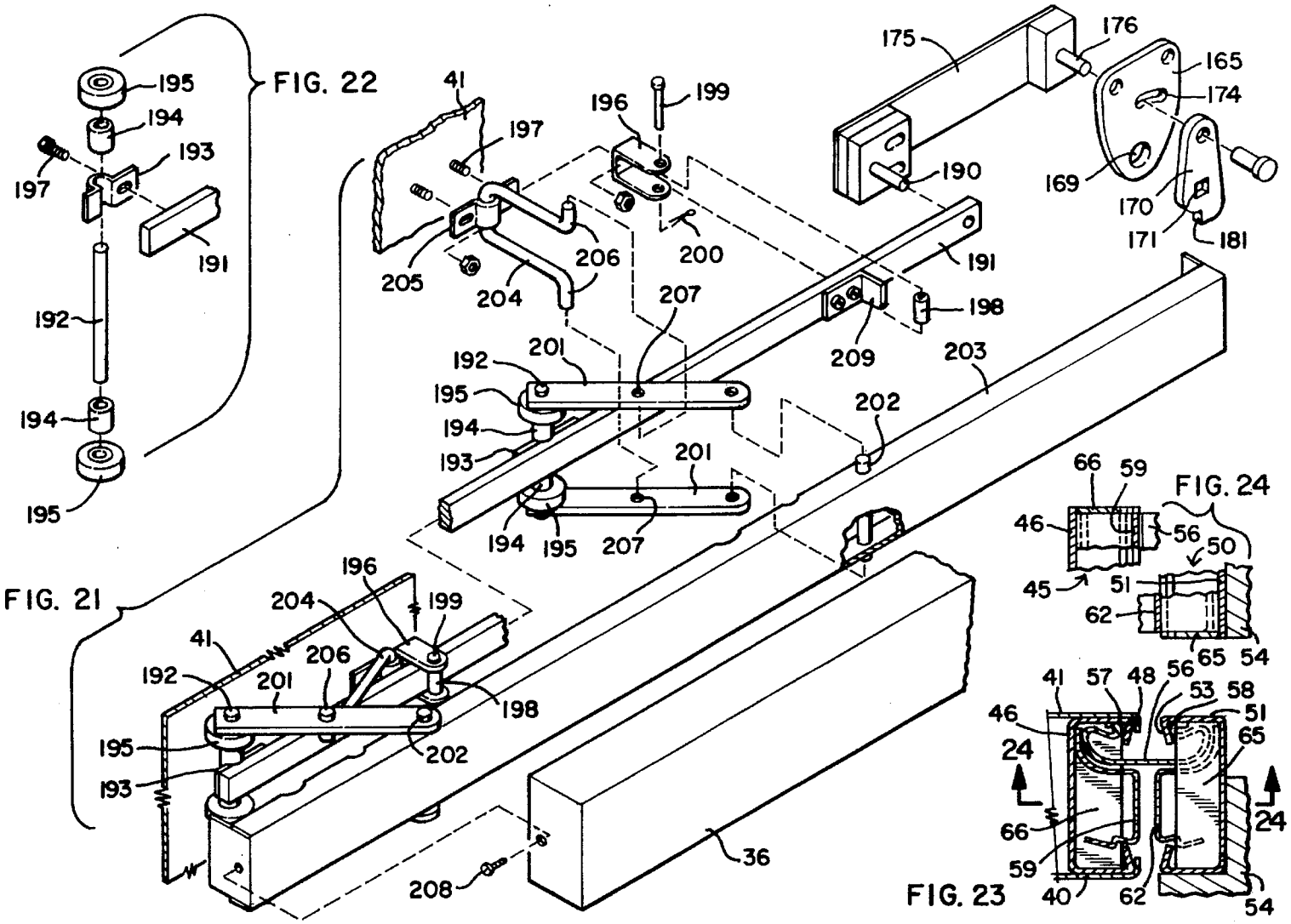

The panic hardware is operated so that when a door is closed and the nose piece and latching element are extended, push bar 36 projects beyond the surface of door side 41 as shown in FIGS. 17 and 5. In this position, push bar 36 can easily be pushed by a person desiring to open the door. As shown in FIGS. 16, 17, and 21, panic hardware connecting bar 175 which is pivotally connected at one end to retraction crank 165 by pin 176, is pivotally connected at its other end by pin 190 to retraction bar 191. Axles 192 are secured to the back (side away from push bar 36) of retraction bar 191 by brackets 193, FIGS. 21 and 22, secured by screws 194 to the back of retraction bar 191. Spacers 194 position rollers 195 on opposite sides of axles 192 spaced from the sides of retraction bar 191. Retraction bar 191 is supported inside door 33 for back and forth longitudinal movement by U-shaped support brackets 196 which are secured to the inside surface of door side 41 by bolts 197. With retraction bar 191 positioned in brackets 196, rollers 198 are secured over the open ends of the brackets 196 by pins 199 secured by cotter pins 200. In this way, retraction bar 191 is held in position with rollers 195 against door side 41 and rollers 198 against the front side of retraction bar 191 and retraction bar 191 is free to move longitudinally inside the door. Such movement in the arrangement shown is parallel to door sides 40 and 41.

Handle or push bar links 201 have ends thereof pivotally mounted on opposite ends of axles 192 outwardly of rollers 195 with opposite ends of the links 201 pivotally connected by pins 202 to a handle 203. U-shaped mounting arms 204 are pivotally connected to the inside surface of door side 41 by mounting brackets 205 which capture the webs of the U-shaped mounting arms 204 so that an arm extends outwardly on opposite sides of bracket 205. Mounting brackets 205 are secured to the inside surface of side 41 by bolts 197, one of which bolts for each bracket also secures one of the brackets 196. The ends 206 of the arms 204 are bent and are received in holes 207 located intermediate the length of push bar links 201. The arms 204 thereby attach links 201 to door side 41 with each arm forming a guiding link pivotally attached to the door and to a push bar link. Push bar 36 is placed over handle 203 and is secured by screws 208. Push bar 36 holds pins 202 in place in handle 203.

As is apparent from a comparison of FIG. 17 which shows push bar 36 in extended position and FIG. 16 which shows push bar 36 in pushed position, as push bar 36 is pushed toward and into door 33, rollers 195 roll along the inside surface of door side 41 and, along with the ends of links 210 adjacent roller 195, move to the left in FIGS. 16 and 17. This causes retraction bar 191 to also move to the left which, through panic hardware connecting bar 175, causes retraction crank 165 to rotate to retract nose piece 73 and latching element 120. Thus, as push bar 36 is pushed into the door, movement is imparted to retraction bar 191 in a direction substantially perpendicular to the direction of movement of the push bar. As long as nose piece 73 remains retracted, push bar 36 will remain in pushed position shown in FIG. 6 substantially flush with door side 40. Since panic hardware connecting bar 175 moves with rotation of retraction crank 165, even if the nose piece is retracted by rotation of handle 37, push bar 36 will move to its retracted position substantially flush with door side 40. If the nose piece is released to move to its extended position, such release causes retraction crank 165 to rotate to pull panic hardware connecting bar 175 and retraction bar 191 to the right. This pulls rollers 195 and the ends of links 201 adjacent thereto to the right which causes push bar 36 to move to the extended position shown in FIG. 17, in which it extends from the side of the door. A stop arm 209, FIGS. 17 and 21, is secured to retraction bar 191 to hit against one of the rollers 198 after desired movement of retraction bar 191 to stop further movement of retraction bar 191 to the right and further outward movement of push bar 36.

In some instances, it is desirable to disable the panic hardware upon the door reaching a certain temperature so that with a fire directly adjacent the door, the door is better able to remain closed, if, for example, high pressure water from a fire hose were to impinge upon and push push bar 36. In order to disable the panic hardware in case of high temperature in the door, pin 166 which connects retraction crank 165 to hardware coupling 160 may be made of a material which will melt upon reaching a certain set temperature and thereby disconnect the panic hardware and door handle from the nose piece. Operation of the panic hardware or door handle in such circumstances will not retract the nose piece.

Alternately, a spring biased locking element 210, FIGS. 6, 7, and 12, may be pivotally mounted in forward door channel 70 by pin 211 which extends through channel piece 71 adjacent the web thereof and is held in place by cotter pin 212, FIG. 5. Locking element 210 is generally maintained in upright position shown in FIGS. 5, 6, 7, and 12 against the biasing force of spring 213 by screw 214 which freely passes through hole 215 in the web of channel piece 71 and is received in receiving nut material 216 on the opposite side of the web. Nut material 216 is material which melts at a desired temperature. When the inside of the door surrounding nut material 216 reaches the desired temperature, material 216 melts releasing screw 213 and locking element 210 which is forced by spring 214 into horizontal position. In horizontal position, locking element 210 holds nose piece 72 in extended position and blocks movement of nose piece 72 to retracted position. It should be noted that except when locking element 210 is provided and has moved to its locking position because of extreme heat inside the door, the door nose pieces remain unlocked and may be moved to a retracted position at any time by applying an external force to a nose piece to move it to retracted position. The only force needed to move the nose piece is a force to overcome the biasing force of spring 125.

As is apparent from the above disclosure, when double doors of the invention are used, both doors are active and either door will close with the other already in closed position. One door does not have to be closed first followed by the other door. Further, the door operating hardware is mounted entirely within the door with only the push bar and door handle extending therefrom for operation of the door. This makes the door very unobtrusive in its open position. When open, the push bar is generally held flush with the surface of the door. The door handle is between the door and wall so is not visible.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. An emergency door, comprising:

a door body having a forward edge and a rearward edge said rearward edge adapted to accept hinge means for mounting the door for rotation about the hinge means between an open and a closed position;

a nose piece mounted to extend along a substantial portion of the forward edge of the door body for movement outwardly from the door body to an extended position, whereby said nose piece can engage with a mating piece adjacent the forward edge of the door when the door is in the closed position to thereby close any gap that might otherwise be present along the forward edge of the door when in the closed position, and inwardly toward the door body to a retracted position whereby said nose piece is free of engagement with a mating piece adjacent the forward edge of the door so the door can move from the closed position to an open position;

a push bar mounted in one side of the door operably connected to the nose piece so that pushing on the push bar will cause movement of the nose piece from the extended position to the retracted position, said push bar projecting from the door when the nose piece is in the extended position and being substantially flush with the door when the nose piece is moved to the retracted position;

catch means automatically operable upon movement of the nose piece to retracted position during opening of the door for holding the nose piece in the retracted position during opening of the door and during the time the door remains in an open position, thereby maintaining the door in condition for closing and allowing the push bar to remain substantially flush with the door during the time the door remains in an open position; and release means to release the nose piece from the retracted position to the extended position when the door is moved from an open to the closed position.

2. An emergency door according to claim 1, additionally including bias means for biasing the nose piece to extended position.

3. An emergency door according to claim 1, additionally including;

latch means adapted to be received in a receiving recess when the door is in closed position to thereby hold the door in closed position.

4. An emergency door according to claim 3, wherein the door has a top edge, and wherein the latch means includes a latching element adapted to extend into an extended, latched position from the top edge of the door.

5. An emergency door according to claim 4,including catch means for holding the latching element in retracted position which also holds the nose piece in retracted position, and catch release means which extends above the top edge of the door when the catch is in a position for holding the latching element in retracted position and is adapted to be moved by door framing adjacent the top edge of the door when the door is in closed position to release the catch means and allow the latching element and nose piece to move to extended position.

6. An emergency door according to claim 1, wherein the means for moving the nose piece includes:

a nose piece control member extending along a substantial portion of the forward edge of the door body;

elongate link means pivotally connected to both the forward edge of the door and to the nose piece control member to thereby connect the nose piece control member to the forward edge of the door whereby movement of the nose piece control member along the forward edge of the door causes rotation of the link means in relation to the door and causes movement of the nose piece control member toward or away from the door as the link means rotate;

means for moving the nose piece control member along the forward edge of the door; and means for transferring the movement of the nose piece control member away from the door to the nose piece.

7. An emergency door according to claim 6, additionally including:

latch means adapted to be received in a receiving recess when the door is in closed position to thereby hold the door in closed position.

8. An emergency door according to claim 7, wherein the door has a top edge, wherein the latch means includes a latching element adapted to extend into an extended, latching position from the top edge of the door.

9. An emergency door according to claim 8, including:

means to bias the latching element to extended latching position;

means connecting the latching element to the nose piece control member so that movement of the latching element to extended latching position causes movement of the nose piece control member along the forward edge of the door;

stop means to limit travel of the nose piece control member and the latching element when the nose piece and latching element have been extended from the door a desired distance; and pulling means for pulling the nose piece inwardly from extended to retracted position;

wherein the means for transferring the movement of the nose piece control member to the nose piece also transfers the inward movement of the nose piece to the control member to move the control member along the forward edge of the door and thereby move the latching member to retracted position against the bias of the means to bias the latching element.

10. An emergency door according to claim 9, wherein the pulling means includes a push bar on one side of the door, and means for translating pushing movement of the push bar toward the door into pulling movement of the nose piece.

11. An emergency door according to claim 10, wherein the means for translating pushing movement of the push bar includes:

a retraction bar;

means mounting the retraction bar interiorly of the door for back and forth longitudinal movement;

means coupling the retraction bar to the nose piece;

push bar link means pivotally connected to the retraction bar and to the push bar; and guiding link means pivotally connected to the push bar link means and to the door;

whereby, when the push bar is pushed to move in a direction into the door, inter-action of the push bar link means and the guiding link means cause the retraction bar to move in a longitudinal direction substantially perpendicular to the direction of movement of the push bar to pull, through the means coupling the retraction bar to the nose piece, the nose piece to retracted position.

12. An emergency door according to claim 11, wherein the means coupling the retraction bar to the nose piece includes a retraction crank connected to the retraction bar and coupled to the nose piece so that longitudinal movement of the retraction bar causes movement of the retraction crank and pulling of the nose piece, and including door handle means rotatably mounted on the side of the door opposite that having the push bar, and means coupling the door handle means to the retraction crank so that rotation of the door handle means causes movement of the retraction crank and pulling of the nose piece.

13. An emergency door according to claim 12, including catch means for holding the latching element in retracted position which also holds the nose piece in retracted position, and catch release means which extends above the top edge of the door when the catch is in a position for holding the latching element in retracted position and is adapted to be moved by door framing adjacent the top edge of the door when the door is in closed position to release the catch means and allow the latching element and nose piece to move to extended position.

14. An emergency door according to claim 13, wherein the catch means includes a shoulder on the latching element and a rotatable catch element having a surface to engage the shoulder to hold the latching element in retracted position, and wherein the catch release means includes a cam means secured to the rotatable catch element and positioned so that when the catch element is rotated into position to hold the latching element in retracted position, the cam means extends from the top edge of the door, whereby when the door is moved to closed position, door framing adjacent the top edge of the door causes the cam means to rotate and to rotate the catch element to release the latching element and allow it to move to extended position.

15. An emergency door according to claim 12, wherein the coupling of the nose piece to the retraction crank includes a link which melts at a preset temperature whereby, if the temperature of the link reaches the preset temperature, the link melts and the nose piece is no longer coupled to the retraction crank.

16. An emergency door according to claim 9, wherein the means connecting the latching element to the nose piece control member is adjustable so that the relative positions of the latching element and the nose piece control member are adjustable to thereby allow adjustment of the extended portion of the latching element relative to the extended position of the nose piece.

17. An emergency door according to claim 1, wherein means are provided to disable the means for moving the nose piece when the temperature of the door reaches a preset temperature.

18. An emergency door according to claim 1, additionally including hinge means for mounting the door to a jamb surface, such hinge means including:

a generally C-shaped elongate hinge piece having opposite, inwardly directed elongate margins;

a door hinge piece receiving channel extending along the rearward edge of the door body for matingly receiving an elongate margin of the door hinge piece and having a top;

door hinge piece retaining means positioned in the door hinge piece receiving channel to retain the received elongate margin of the hinge piece in the door hinge piece receiving channel during opening and closing of the door;

door support means at the top of the door hinge piece receiving channel to rest on and remain above a hinge piece received in the channel to thereby maintain the door in fixed vertical position in relation to the hinge piece;

a jamb mounting piece adapted to be mounted to a jamb surface and having a jamb hinge piece receiving channel therein to receive the opposite elongate margin of the hinge piece therein and having a bottom;

jamb hinge piece retaining means positioned in the jamb hinge piece receiving channel to retain the received elongate margin of the hinge piece in the jamb hinge piece receiving channel during opening and closing of the door; and hinge piece support means at the bottom of the jamb hinge piece receiving channel upon which the hinge piece received in the jamb hinge piece receiving channel rests to thereby maintain the hinge piece in fixed vertical position in relation to the mounting piece.

19. An emergency door comprising:

a door body having a forward edge and a rearward edge said rearward edge adapted to accept hinge means for mounting the door for rotation about the hinge means between an open and a closed position;

a nose piece mounted to extend along a substantial portion of the forward edge of the door body for movement outwardly from the door body to an extended position, whereby said nose piece can engage with a mating piece adjacent the forward edge of the door when the door is in the closed position to thereby close any gap that might otherwise be present along the forward edge of the door when in the closed position, and inwardly toward the door body to a retracted position whereby said nose piece is free of engagement with a mating piece adjacent the forward edge of the door so the door can move from the closed position to an open position;

means operable by a person desiring to open the door for moving the nose piece from extended position to retracted position;

a nose piece control member extending along a substantial portion of the forward edge of the door body;

elongate link means pivotally connected to both the forward edge of the door and to the nose piece control member to thereby connect the nose piece control member to the forward edge of the door whereby movement of the nose piece control member along the forward edge of the door causes rotation of the link means in relation to the door and causes movement of the nose piece control member toward or away from the door as the link means rotate;

means for moving the nose piece control member along the forward edge of the door; and means for transferring the movement of the nose piece control member away from the door to the nose piece.

20. An emergency door according to claim 19, including:

means to bias the nose piece control member in a direction along the forward edge of the door to cause the nose piece control member to move away from the door;

stop means to limit travel of the nose piece control member in its biased direction when the nose piece has been extended from the door a desired distance; and pulling means for pulling the nose piece inwardly from the extended to the retracted position;

wherein the means for transferring the movement of the nose piece control member to the nose piece also transfers the inward movement of the nose piece to the control member to move the control member along the forward edge of the door against the bias of the bias means when the nose piece is pulled inwardly from the extended position.

21. An emergency door according to claim 20, wherein the pulling means includes a push bar on one side of the door, and means for translating pushing movement of the push bar toward the door into pulling movement of the nose piece.

22. An emergency door according to claim 21, wherein the means for translating pushing movement of the push bar includes:

a retraction bar;

means mounting the retraction bar interiorly of the door for back and forth longitudinal movement;

means coupling the retraction bar to the nose piece;

push bar link means pivotally connected to the retraction bar and to the push bar; and guiding link means pivotally connected to the push bar link means and to the door;

whereby, when the push bar is pushed to move in a direction into the door, inter-action of the push bar link means and the guiding link means cause the retraction bar to move in a longitudinal direction substantially perpendicular to the direction of movement of the push bar to pull, through the means coupling the retraction bar to the nose piece, the nose piece to retracted position.

23. An emergency door according to claim 22, wherein the means coupling the retraction bar to the nose piece includes a retraction crank connected to the retraction bar and coupled to the nose piece so that longitudinal movement of the retraction bar causes movement of the retraction crank and pulling of the nose piece, and including door handle means rotatably mounted on the side of the door opposite that having the push bar, and means coupling the door handle means to the retraction crank so that rotation of the door handle means causes movement of the retraction crank and pulling of the nose piece.

24. In an emergency door including hinge means for mounting the door to a jamb surface, such hinge means including a generally C-shaped elongate hinge piece having opposite, inwardly directed elongate margins, a door hinge piece receiving channel extending along the rearward edge of the door body for matingly receiving an elongate margin of the door hinge piece and having a top, door hinge piece retaining means positioned in the door hinge piece receiving channel to retain the received elongate margin of the hinge piece in the door hinge piece receiving channel during opening and closing of the door, a jamb mounting piece adapter to be mounted to a jamb surface and having a jamb hinge piece receiving channel therein to receive the opposite elongate margin of the hinge piece therein and having a bottom, and jamb hinge piece retaining means positioned on the jamb hinge piece receiving channel to retain the received elongate margin of the hinge piece in the jamb hinge piece receiving channel during opening and closing of the door, the improvement comprising:

a hinge piece support means secured at the bottom of the jamb hinge piece receiving channel upon which the hinge piece received in the jamb hinge piece receiving channel rests to thereby maintain the hinge piece in fixed vertical position in relation to the jamb mounting piece when the jamb mounting piece is mounted to the jamb surface; and a door support means at the top of the hinge piece receiving channel to rest on and remain above a hinge piece received in the channel to thereby maintain the door in fixed vertical position on relation to the piece when the door is mounted by the hinge means to the jamb surface.

25. Apparatus in combination with a door for retracting a latching element in the door when it is desired to open the door, wherein the apparatus is inside the door except for a push bar extending from the door to be pushed by a person desiring to open the door, comprising:

a retraction bar;

means mounting the retraction bar interiorly of the door for back and forth longitudinal movement;

means coupling the retraction bar to the latching element so that longitudinal movement of the retraction bar in one direction causes retraction of the latching element;

push bar link means pivotally connected to the retraction bar and to the push bar; and guiding link means pivotally connected to the push bar link means and to the door;

whereby, when the push bar is pushed to move in a direction into the door, interaction of the push bar link means and the guiding link means cause the retraction bar to move in a longitudinal direction substantially perpendicular to the direction of movement of the push bar to pull, through the means coupling the retraction bar to the latching element, the latching element to retracted position.

* * * * *